US010714002B2

(12) United States Patent
Lu et al.

(10) Patent No.: US 10,714,002 B2
(45) Date of Patent: Jul. 14, 2020

(54) PIXEL CIRCUIT AND DRIVING METHOD THEREOF, DISPLAY PANEL AND DISPLAY DEVICE

(71) Applicant: BOE TECHNOLOGY GROUP CO., LTD., Beijing (CN)

(72) Inventors: Pengcheng Lu, Beijing (CN); Xiaochuan Chen, Beijing (CN); Minghua Xuan, Beijing (CN); Shengji Yang, Beijing (CN); Lei Wang, Beijing (CN); Li Xiao, Beijing (CN); Dongni Liu, Beijing (CN); Jie Fu, Beijing (CN); Han Yue, Beijing (CN); Jian Gao, Beijing (CN); Changfeng Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 21 days.

(21) Appl. No.: 16/098,235

(22) PCT Filed: Apr. 13, 2018

(86) PCT No.: PCT/CN2018/082964
§ 371 (c)(1),
(2) Date: Nov. 1, 2018

(87) PCT Pub. No.: WO2018/223771
PCT Pub. Date: Dec. 13, 2018

(65) Prior Publication Data

US 2019/0287455 A1 Sep. 19, 2019

(30) Foreign Application Priority Data

Jun. 8, 2017 (CN) ..... 2017 1 0429459

(51) Int. Cl.
*G09G 3/30* (2006.01)
*G09G 3/36* (2006.01)
(Continued)

(52) U.S. Cl.
CPC ..... *G09G 3/3225* (2013.01); *G09G 3/32* (2013.01); *G09G 3/2018* (2013.01);
(Continued)

(58) Field of Classification Search
CPC .. G09G 3/30; G09G 3/36; G09G 5/00; G09G 5/08; G06F 3/038; G06F 3/033
See application file for complete search history.

(56) References Cited

U.S. PATENT DOCUMENTS 6,774,876 B2 * 8/2004 Inukai ..... G09G 3/3266 315/169.3
7,928,938 B2 * 4/2011 Osame ..... G09G 3/2022 345/82
(Continued)

FOREIGN PATENT DOCUMENTS

CN 101008756 A 8/2007
CN 101261810 A 9/2008
(Continued)

OTHER PUBLICATIONS

International Search Report and Written Opinion dated Jun. 27, 2018 from State Intellectual Property Office of the P.R. China.

*Primary Examiner* — Pegeman Karimi
(74) *Attorney, Agent, or Firm* — Dilworth & Barrese, LLP.; Michael J. Musella, Esq.

(57) ABSTRACT

A pixel circuit and a driving method thereof, a display panel and a display device are disclosed. The pixel circuit includes an input control sub-circuit, a switch control sub-circuit, a latch sub-circuit and a light-emitting sub-circuit. The input control sub-circuit writes a data signal into a first node under
(Continued)

control of the gate signal terminal. The switch control sub-circuit conducts a first terminal or a second terminal of the latch sub-circuit with the first node under control of a switch signal control terminal. The latch sub-circuit outputs a high-level signal to the first node, when the first node is conductive with the first terminal and outputs a low-level signal to the first node, when the first node is conductive with the second terminal. The light-emitting sub-circuit emits light when the first node is supplied with the high-level signal.

20 Claims, 5 Drawing Sheets

(51) Int. Cl.

| | |
|---|---|
| ***G09G 3/3225*** | (2016.01) |
| ***G09G 3/32*** | (2016.01) |
| *G09G 3/20* | (2006.01) |

(52) U.S. Cl.
CPC ..... *G09G 2300/0426* (2013.01); *G09G 2310/0243* (2013.01); *G09G 2330/021* (2013.01)

(56) References Cited

U.S. PATENT DOCUMENTS

| | | | | |
|---|---|---|---|---|
| 8,378,945 | B2 * | 2/2013 | Harada | G09G 3/3614 345/92 |
| 2002/0021295 | A1 | 2/2002 | Koyama et al. | |
| 2007/0176875 | A1 * | 8/2007 | Kageyama | G09G 3/3659 345/92 |
| 2013/0307421 | A1 * | 11/2013 | Tanada | H05B 37/00 315/172 |
| 2019/0287459 | A1 * | 9/2019 | Liu | G09G 3/3233 |

FOREIGN PATENT DOCUMENTS

| | | | |
|---|---|---|---|
| CN | 106782311 | A | 5/2017 |
| CN | 106991975 | A | 7/2017 |

* cited by examiner

PIXEL CIRCUIT AND DRIVING METHOD THEREOF, DISPLAY PANEL AND DISPLAY DEVICE

The present application claims priority of Chinese Patent Application No. 201710429459.7, filed on Jun. 8, 2017, the disclosure of which is incorporated herein by reference in its entirety as part of the present application.

TECHNICAL FIELD

Embodiments of the present disclosure relate to a pixel circuit and a driving method thereof, a display panel and a display device.

BACKGROUND

With advancement of the display technology, electroluminescent display panels have gradually become one of the hotspots in the research field of flat panel display panels at present, and more and more active matrix organic light emitting diode (AMOLED) displays have entered the market. As compared with a conventional thin film transistor-liquid crystal display (TFT-LCD), an AMOLED display has a faster response speed, a higher contrast ratio, and a wider viewing angle.

A circuit structure of a typical AMOLED pixel circuit, as shown in FIG. 1, includes: a drive transistor m1, a switch transistor m2, a storage capacitor c, and an organic light-emitting diode OLED; a gate electrode of the drive transistor m1 is respectively connected with a drain electrode of the switch transistor m2 and one terminal of the storage capacitor c, a source electrode of the drive transistor m1 is connected with an anode of the organic light-emitting diode OLED, and a drain electrode of the drive transistor m1 is respectively connected with the other terminal of the storage capacitor c and a high-level signal terminal VDD; a gate electrode of the switch transistor m2 is connected with a gate signal terminal Gate line, a source electrode of the switch transistor m2 is connected with a data signal terminal Data line; and a cathode of the organic light-emitting diode OLED is connected with a low-level signal terminal VSS.

FIG. 2 is a working timing diagram of the pixel circuit shown in FIG. 1 within display time of one frame. It may be known from FIG. 2 that, during a time period t1, the gate signal terminal Gate line inputs a high-level signal, and the switch transistor m2 is turned on, at which time a data signal on the data signal terminal Data line is written to the storage capacitor c and the gate electrode of the drive transistor m1, so that the drive transistor m1 is turned on, and the organic light-emitting diode OLED starts to work and emit light; during a time period t2, the gate signal terminal Gate line inputs a low-level signal, and the switch transistor m2 is turned off, at which time, due to an electric discharge effect of the storage capacitor c, the gate electrode of the drive transistor m1 maintains a high-level state, the drive transistor m1 continues to be turned on, and the organic light-emitting diode OLED continues to work and emit light until a data signal for displaying a next frame is input, therefore ensuring the continuity of a display picture.

However, when the AMOLED displays a fixed-grayscale static picture within display time of multiple frames, the pixel circuit shown in FIG. 1 needs to repeatedly refresh the data signal on the data signal terminal Data line within display time of each frame, which results in large power consumption of the pixel circuit.

SUMMARY

An embodiment of the present disclosure provides a pixel circuit, comprising: an input control sub-circuit, a switch control sub-circuit, a latch sub-circuit and an light-emitting sub-circuit; wherein the input control sub-circuit is configured to write a data signal supplied by a data signal terminal into a first node under control of a gate signal terminal; the switch control sub-circuit is configured to conduct a first terminal or a second terminal of the latch sub-circuit with the first node under control of a switch signal control terminal; the latch sub-circuit is configured to: output a high-level signal supplied by a high-level signal terminal to the first node, when the first node is conductive with the first terminal of the latch sub-circuit, and output a low-level signal supplied by a low-level signal terminal to the first node, when the first node is conductive with the second terminal of the latch sub-circuit; and the light-emitting sub-circuit is configured to emit light when the first node is supplied with the high-level signal.

In a possible implementation example, in the pixel circuit by an embodiment of the present disclosure, a control terminal of the input control sub-circuit is connected with the gate signal terminal, an input terminal of the input control sub-circuit is connected with the data signal terminal, and an output terminal of the input control sub-circuit is connected with the first node; a control terminal of the switch control sub-circuit is connected with the switch signal control terminal, a first terminal of the switch control sub-circuit is connected with the first node, a second terminal of the switch control sub-circuit is connected with the first terminal of the latch sub-circuit, and a third terminal of the switch control sub-circuit is connected with the second terminal of the latch sub-circuit; a third terminal of the latch sub-circuit is connected with the high-level signal terminal, and a fourth terminal of the latch sub-circuit is connected with the low-level signal terminal; and the light-emitting sub-circuit is connected between the first node and the low-level signal terminal.

In a possible implementation example, in the pixel circuit by an embodiment of the present disclosure, a time period during which the first terminal of the latch sub-circuit is conductive with the first node and a time period during which the second terminal of the latch sub-circuit is conductive with the first node are both related to a voltage of the data signal.

In a possible implementation example, in the pixel circuit by an embodiment of the present disclosure, the smaller a voltage difference between the data signal and the high-level signal, the longer the time period during which the first terminal of the latch sub-circuit is conductive with the first node within display time of one frame.

In a possible implementation example, in the pixel circuit by an embodiment of the present disclosure, the input control sub-circuit includes: a first switch transistor and a capacitor; a gate electrode of the first switch transistor is connected with the gate signal terminal, a source electrode of the first switch transistor is connected with the data signal terminal, and a drain electrode of the first switch transistor is connected with the first node; and a first terminal of the capacitor is connected with the first node, and a second terminal of the capacitor is grounded.

In a possible implementation example, in the pixel circuit by an embodiment of the present disclosure, the switch control sub-circuit includes: a second switch transistor and a third switch transistor that are oppositely doped; a gate electrode of the second switch transistor and a gate electrode of the third switch transistor are respectively connected with the switch signal control terminal; a source electrode of the second switch transistor and a drain electrode of the third switch transistor are respectively connected with the first node; a drain electrode of the second switch transistor is connected with the first terminal of the latch sub-circuit; and a source electrode of the third switch transistor is connected with the second terminal of the latch sub-circuit.

In a possible implementation example, in the pixel circuit by an embodiment of the present disclosure, the second switch transistor is an N-type transistor, and the third switch transistor is a P-type transistor; the longer a time period of the high-level signal input by the switch signal control terminal, the longer the time period during which the first terminal of the latch sub-circuit is conductive with the first node; or, the second switch transistor is a P-type transistor, and the third switch transistor is an N-type transistor; the longer a time period of the low-level signal input by the switch signal control terminal, the longer the time period during which the first terminal of the latch sub-circuit is conductive with the first node.

In a possible implementation example, in the pixel circuit by an embodiment of the present disclosure, the latch sub-circuit includes: a fourth switch transistor and a fifth switch transistor that are oppositely doped, and a sixth switch transistor and a seventh switch transistor that are oppositely doped, a gate electrode of the fourth switch transistor and a gate electrode of the fifth switch transistor are respectively connected with the second terminal of the latch sub-circuit; a drain electrode of the fourth switch transistor and a drain electrode of the fifth switch transistor are respectively connected with the first terminal of the latch sub-circuit; a gate electrode of the sixth switch transistor and a gate electrode of the seventh switch transistor are respectively connected with the first terminal of the latch sub-circuit; a drain electrode of the sixth switch transistor and a drain electrode of the seventh switch transistor are respectively connected with the second terminal of the latch sub-circuit; a source electrode of the fourth switch transistor and a source electrode of the sixth switch transistor are respectively connected with the low-level signal terminal; and a source electrode of the fifth switch transistor and a source electrode of the seventh switch transistor are respectively connected with the high-level signal terminal.

In a possible implementation example, in the pixel circuit by an embodiment of the present disclosure, the fourth switch transistor and the sixth switch transistor are N-type transistors, and the fifth switch transistor and the seventh switch transistor are P-type transistors; or, the fourth switch transistor and the sixth switch transistor are P-type transistors, and the fifth switch transistor and the seventh switch transistor are N-type transistors.

In a possible implementation example, in the pixel circuit by an embodiment of the present disclosure, the light-emitting sub-circuit includes: a light-emitting diode; an anode of the light-emitting diode is connected with the first node, and a cathode of the light-emitting diode is connected with the low-level signal terminal.

In a possible implementation example, in the pixel circuit by an embodiment of the present disclosure, the light-emitting diode includes: an organic light-emitting diode or a quantum dot light-emitting diode.

An embodiment of the present disclosure further provides a driving method of any one of the above-mentioned pixel circuits, comprising: writing, by an input control sub-circuit, a data signal supplied by a data signal terminal into a first node under control of a gate signal terminal; conducting, by a switch control sub-circuit, a first terminal or a second terminal of a latch sub-circuit with the first node under control of a switch signal control terminal; outputting, by the latch sub-circuit, a high-level signal supplied by a high-level signal terminal to the first node, when the first node is conductive with the first terminal of the latch sub-circuit; outputting, by the latch sub-circuit, a low-level signal supplied by a low-level signal terminal to the first node, when the first node is conductive with the second terminal of the latch sub-circuit; and emitting light by the light-emitting sub-circuit, when the first node is supplied with the high-level signal.

In a possible implementation example, in the driving method of an embodiment of the present disclosure, the smaller a voltage difference between the data signal and the high-level signal, the longer a time period during which the first terminal of the latch sub-circuit is conductive with the first node within display time of one frame.

In a possible implementation example, in the driving method of an embodiment of the present disclosure, only within display time of a first frame, the data signal terminal loads the data signal; and within display time of each frame, the switch signal control terminal loads switch control signals of a same duty cycle.

An embodiment of the present disclosure further provides a display panel, comprising any one of the above-mentioned pixel circuits.

An embodiment of the present disclosure further provides a display device, comprising any one of the above-mentioned pixel circuits.

BRIEF DESCRIPTION OF THE DRAWINGS

In order to clearly illustrate the technical solution of the embodiments the present disclosure or in the prior art, the drawings to be used in description of the embodiments or the prior art will be briefly described in the following; it is obvious that the described drawings are only related to some embodiments of the present disclosure. Based on the drawings, those ordinarily skilled in the art can obtain other drawings, without any inventive work.

DETAILED DESCRIPTION

Hereinafter, the technical solutions of the embodiments of the present disclosure will be described in a clearly and fully understandable way in connection with the drawings related to the embodiments of the present disclosure. It is obvious that the described embodiments are just a part but not all of the embodiments of the present disclosure. Based on the described embodiments herein, those ordinarily skilled in the art can obtain other embodiment(s), without any inventive work, which should be within the scope of the present disclosure.

Hereinafter, actual implementation modes of a pixel circuit and a driving method thereof, a display panel and a display device provided by the embodiments of the present disclosure will be described in detail in conjunction with the accompanying drawings.

The embodiments of the present disclosure provide a pixel circuit and a driving method thereof, a display panel and a display device, to solve the problem of how to reduce power consumption of the pixel circuit when a fixed-grayscale static picture is displayed existing in the technology. In the embodiments of the present disclosure, within the display time of one frame, as triggered as a data signal, a switch control sub-circuit can control a time period during which a first terminal or a second terminal of a latch sub-circuit is conductive with a first node, according to a switch control signal loaded by a switch signal control terminal, so as to further implement a gray scale corresponding to a light-emitting sub-circuit within the display time of one frame. Therefore, when the fixed-grayscale static picture is displayed within the display time of multiple frames, the data signal can be loaded by a data signal terminal, only within the display time of a first frame; and within the display time of each frame, switch control signals of the same duty cycle are loaded by the switch signal control terminal, so that as triggered by the data signal loaded within the display time of the first frame, the switch control sub-circuit controls, within the display time of each frame, the time period during which the first terminal or the second terminal of the latch sub-circuit is conductive with the first node, and further it is not necessary to repeatedly refresh the data signal required within the display time of each frame, which reduces the power consumption of the pixel circuit.

Figure 1:
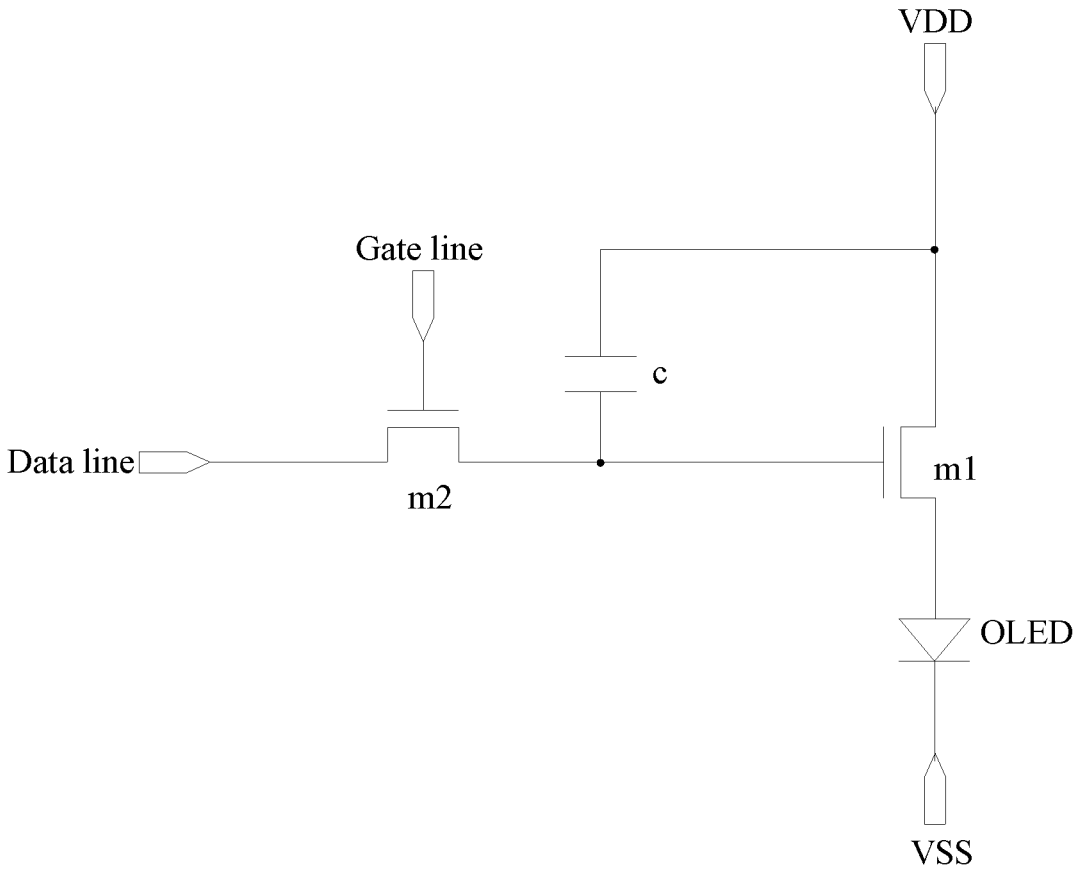
FIG. 1 is a structural schematic diagram of an existing pixel circuit.
Figure 2:
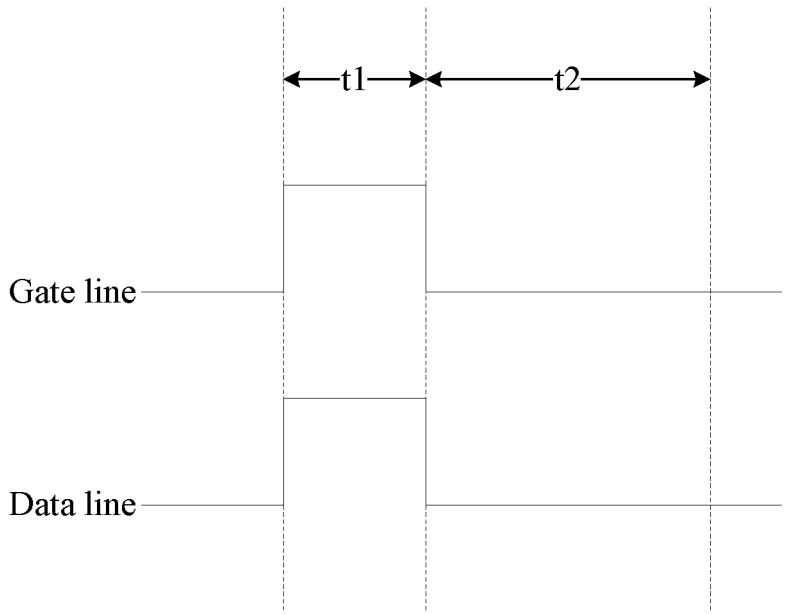
FIG. 2 is a working timing diagram of the pixel circuit shown in FIG. 1.
Figure 3:
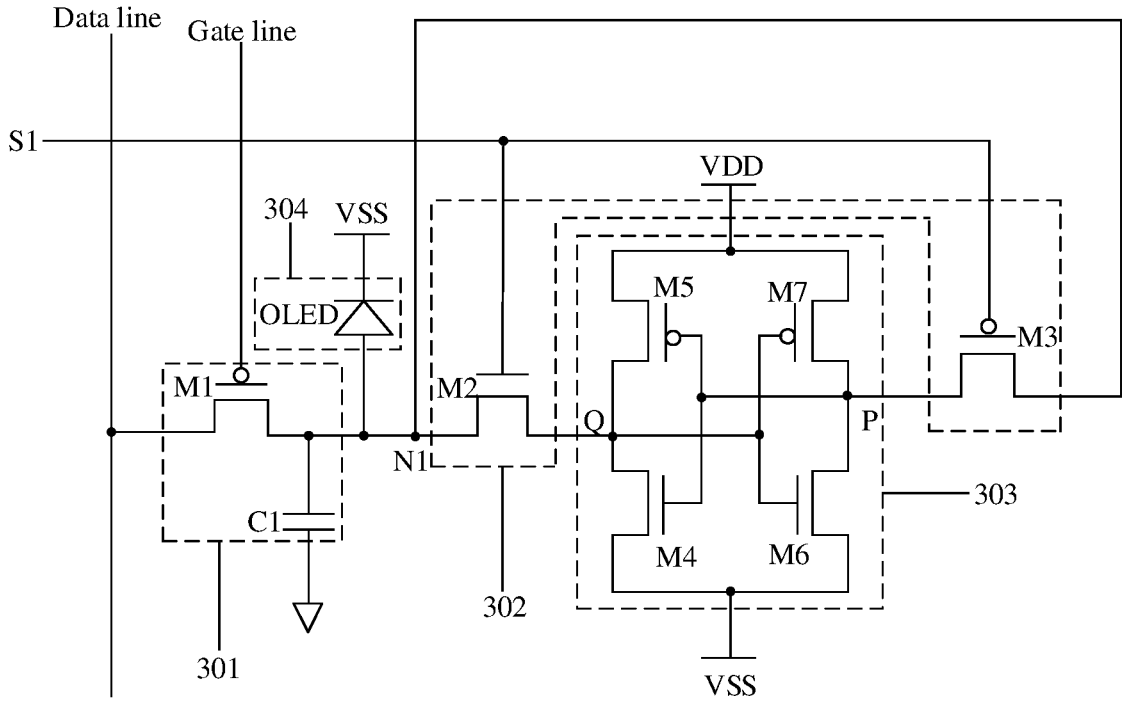
FIG. 3 is a structural schematic diagram of a pixel circuit provided by an embodiment of the present disclosure.

A pixel circuit provided by an embodiment of the present disclosure, as shown in FIG. 3, comprises: an input control sub-circuit 301, a switch control sub-circuit 302, a latch sub-circuit 303 and a light-emitting sub-circuit 304.

For example, a control terminal of the input control sub-circuit 301 is connected with a gate signal terminal Gate line, an input terminal of the input control sub-circuit 301 is connected with a data signal terminal Data line, and an output terminal of the input control sub-circuit 301 is connected with a first node N1. The input control sub-circuit 301 is configured to write a data signal supplied by the data signal terminal Data line into the first node N1, under control of the gate signal terminal Gate line.

A control terminal of the switch control sub-circuit 302 is connected with a switch signal control terminal S1, a first terminal of the switch control sub-circuit 302 is connected with the first node N1, a second terminal of the switch control sub-circuit 302 is connected with a first terminal Q of the latch sub-circuit 303, and a third terminal of the switch control sub-circuit 302 is connected with a second terminal P of the latch sub-circuit 303. The switch control sub-circuit 302 is configured to: conduct the first terminal Q or the second terminal P of the latch sub-circuit 303 with the first node N1, under control of the switch signal control terminal S1; a time period during which the first terminal Q or the second terminal P of the latch sub-circuit 303 is conductive with the first node N1 is related to the voltage of the data signal.

A third terminal of the latch sub-circuit 303 is connected with a high-level signal terminal VDD, and a fourth terminal of the latch sub-circuit 303 is connected with a low-level signal terminal VSS. The latch sub-circuit 303 is configured to: output a high-level signal supplied by the high-level signal terminal VDD to the first node N1, when the first node N1 is conductive with the first terminal Q of the latch sub-circuit 303; and output a low-level signal supplied by the low-level signal terminal VSS to the first node N1, when the first node N1 is conductive with the second terminal P of the latch sub-circuit 303.

The light-emitting sub-circuit 304 is connected between the first node N1 and the low-level signal terminal VSS; and the light-emitting sub-circuit 304 emits light when the first node N1 is supplied with the high-level signal.

In the above-described pixel circuit provided by the embodiment of the present disclosure, within the display time of one frame, as triggered by the data signal, the switch control sub-circuit 302 can control the time period during which the first terminal Q or the second terminal P of the latch sub-circuit 303 is conductive with the first node N1, according to the switch control signal loaded by the switch signal control terminal S1, and further implement a gray scale corresponding to the light-emitting sub-circuit 304 within the display time of one frame. Therefore, when a fixed-grayscale static picture is displayed within the display time of multiple frames, the data signal can be loaded by the data signal terminal, only within the display time of a first frame; and within the display time of each frame, the switch control signals of the same duty cycle are loaded by the switch signal control terminal S1, so that as triggered by the data signal loaded within the display time of the first frame, the switch control sub-circuit 302 controls, within the display time of each frame, the time period during which the first terminal P or the second terminal Q of the latch sub-circuit 303 is conductive with the first node N1, and further it is not necessary to repeatedly refresh the data signal required within the display time of each frame, which reduces power consumption of the pixel circuit.

Moreover, as shown in FIG. 3, in the pixel display circuit provided by the embodiment of the present disclosure, the switch signal control terminal S1 controls ON (turn-on) or OFF (turn-off) of a second switch transistor M2 or a third switch transistor M3 through only one switch signal control line, which saves wiring as well as inputting of a signal source accordingly, and is more favorable for reducing the power consumption of the pixel circuit.

Further, a gray scale reflects a tone's shade level of a display picture, so the higher the level, the greater the brightness of the display picture, and the larger the voltage of the corresponding data signal; within the display time of one frame, it is necessary to control the time period for the light-emitting sub-circuit 304 to emit light to be longer than the time period for it not to emit light; and therefore, in the above-described pixel circuit provided by the embodiment of the present disclosure, the smaller the voltage difference between the data signal and the high-level signal, the longer the time period during which the first terminal Q of the latch sub-circuit 303 is conductive with the first node N1 within the display time of one frame (and in this case, the shorter the time period during which the second terminal P of the latch sub-circuit 303 is conductive with the first node N1). Therefore, the duty cycle of the switch control signal loaded by the switch signal control terminal S1 can be set according to the voltage of the data signal, to further control the time period during which the first terminal Q or the second terminal P of the latch sub-circuit 303 is conductive with the first node N1 within the display time of one frame, and implement the display of pictures of different gray scales.

For example, the duty cycle of the switch control signal can be set according to the voltage of the data signal, to further control the time period during which the first terminal Q of the latch sub-circuit 303 is conductive with the first node N1 within the display time of one frame and the time period during which the second terminal P is conductive with the first node N1, so as to implement the display of pictures of different gray scales.

During implementation, in the above-described pixel circuit provided by the embodiment of the present disclosure, as shown in FIG. 3, the input control sub-circuit 301 includes: a first switch transistor M1 and a capacitor C1.

A gate electrode of the first switch transistor M1 is connected with the gate signal terminal Gate line, a source electrode of the first switch transistor M1 is connected with the data signal terminal Data line, and a drain electrode of the first switch transistor M1 is connected with the first node N1;

A first terminal of the capacitor C1 is connected with the first node N1, and a second terminal of the capacitor C1 is grounded.

Specifically, the first switch transistor M1 is turned on under control of a scan signal input by the gate signal terminal Gate line, and writes the data signal supplied by the data signal terminal Data line into the first node N1.

Further, the scan signal input by the gate signal terminal Gate line is a high-level signal, and the first switch transistor M1 is an N-type thin film transistor; or the scan signal input by the gate signal terminal Gate line is a low-level signal, and the first switch transistor M1 is a P-type thin film transistor. FIG. 3 illustrates with the case where the first switch transistor M1 is a P-type thin film transistor as an example.

It is only a specific structure of the input control sub-circuit 301 that is illustrated above; and during implementation, the specific structure of the input control sub-circuit 301 is not limited to the above-described structure provided by the embodiments of the present disclosure, and may be other structures known to those skilled in the art, which will not be repeated here.

During implementation, in the above-described pixel circuit provided by the embodiment of the present disclosure, as shown in FIG. 3, the switch control sub-circuit 302 includes: a second switch transistor M2 and a third switch transistor M3 that are oppositely doped. For example, as shown in FIG. 3, the second switch transistor M2 is an N-type transistor, and the third switch transistor M3 is a P-type transistor. Alternatively, the second switch transistor M2 is a P-type transistor, and the third switch transistor M3 is an N-type transistor.

A gate electrode of the second switch transistor M2 and a gate electrode of the third switch transistor M3 are respectively connected with the switch signal control terminal S1;

A source electrode of the second switch transistor M2 and a drain electrode of the third switch transistor M3 are respectively connected with the first node N1;

A drain electrode of the second switch transistor M2 is connected with the first terminal Q of the latch sub-circuit 303;

A source electrode of the third switch transistor M3 is connected with the second terminal P of the latch sub-circuit 303.

Specifically, the second switch transistor M2 and the third switch transistor M3 respectively conduct the first terminal Q or the second terminal P of the latch sub-circuit 303 with the first node N1, under control of the switch control signal input by the switch signal control terminal S1, to implement transmitting the data signal of the first node N1 to the first terminal Q or the second terminal P of the latch sub-circuit 303; or, implement transmitting the high-level signal of the first terminal Q or the low-level signal of the second terminal P of the latch sub-circuit 303 to the first node N1.

Further, in the above-described pixel circuit provided by the embodiment of the present disclosure, as shown in FIG. 3, the second switch transistor M2 is an N-type transistor, and the third switch transistor M3 is a P-type transistor; the longer the time period of the high-level signal input by the switch signal control terminal S1, the longer the time period during which the first terminal Q of the latch sub-circuit 303 is conductive with the first node N1.

Alternatively, the second switch transistor M2 is a P-type transistor, and the third switch transistor M3 is an N-type transistor; the longer the time period of the low-level signal input by the switch signal control terminal S1, the longer the time period during which the first terminal Q of the latch sub-circuit 303 is conductive with the first node N1.

It is only a specific structure of the switch control sub-circuit 302 that is illustrated above; and during implementation, the specific structure of the switch control sub-circuit 302 is not limited to the above-described structure provided by the embodiments of the present disclosure, and may be other structures known to those skilled in the art, which will not be repeated here.

During implementation, in order to more clearly describe that the first terminal Q and the second terminal P of the latch sub-circuit 303 work alternately, in the above-described pixel circuit provided by the embodiment of the present disclosure, as shown in FIG. 3, the latch sub-circuit 303 may specifically include:

A fourth switch transistor M4 and a fifth switch transistor M5 that are oppositely doped, and a sixth switch transistor M6 and a seventh switch transistor M7 that are oppositely doped;

A gate electrode of the fourth switch transistor M4 and a gate electrode of the fifth switch transistor M5 are respectively connected with the second terminal P of the latch sub-circuit 303;

A drain electrode of the fourth switch transistor M4 and a drain electrode of the fifth switch transistor M5 are respectively connected with the first terminal Q of the latch sub-circuit 303;

A gate electrode of the sixth switch transistor M6 and a gate electrode of the seventh switch transistor M7 are respectively connected with the first terminal Q of the latch sub-circuit 303;

A drain electrode of the sixth switch transistor M6 and a drain electrode of the seventh switch transistor M7 are respectively connected with the second terminal P of the latch sub-circuit 303;

A source electrode of the fourth switch transistor M4 and a source electrode of the sixth switch transistor M6 are respectively connected with the low-level signal terminal VSS; and A source electrode of the fifth switch transistor M5 and a source electrode of the seventh switch transistor M7 are respectively connected with the high-level signal terminal VDD.

Specifically, in the above-described pixel circuit provided by the embodiment of the present disclosure, the fourth switch transistor M4 and the sixth switch transistor M6 are N-type transistors, and the fifth switch transistor M5 and the seventh switch transistor M7 are P-type transistors, as shown in FIG. 3.

Alternatively, the fourth switch transistor M4 and the sixth switch transistor M6 are P-type transistors, and the fifth switch transistor M5 and the seventh switch transistor M7 are N-type transistors.

It is only a specific structure of the latch sub-circuit 303 that is illustrated above; and during implementation, the specific structure of the latch sub-circuit 303 is not limited to the above-described structure provided by the embodiments of the present disclosure, and may be other structures known to those skilled in the art, which will not be repeated here.

During implementation, in the above-described pixel circuit provided by the embodiment of the present disclosure, the light-emitting sub-circuit 304 includes: a light-emitting diode (for example, an organic light-emitting diode OLED).

An anode of the organic light-emitting diode OLED is connected with the first node N1, and a cathode is connected with the low-level signal terminal VSS.

Of course, the organic light-emitting diode OLED involved in the above-described pixel circuit provided by the embodiment of the present disclosure is an electroluminescent device in an active matrix, and thus the light-emitting sub-circuit 304 is not merely limited to the organic light-emitting diode OLED, and may also be a quantum dot light-emitting diode QLED, which will not be limited here.

Figure 4:
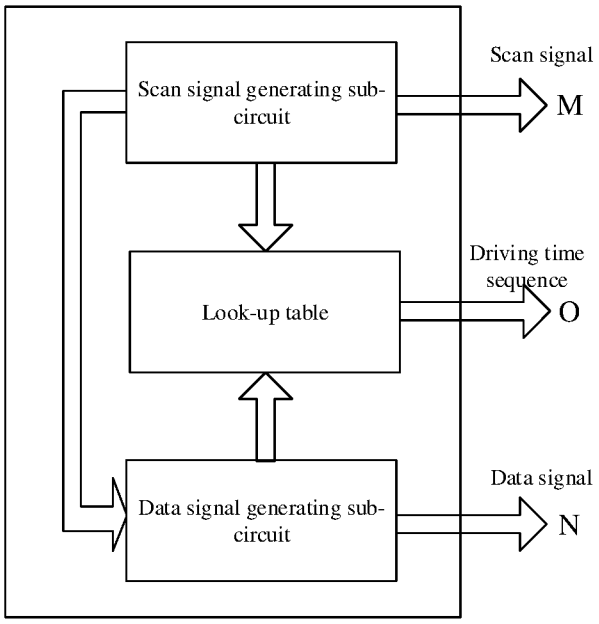
FIG. 4 is a structural schematic diagram of a time sequence control sub-circuit provided by the embodiment of the present disclosure.

During implementation, the driving time sequence of the switch control signal supplied by the switch signal control terminal S1 is in one-to-one correspondence with the data signal, and may be pre-stored into a look-up table for the time sequence control sub-circuit as shown in FIG. 4. The time sequence control sub-circuit may include a scan signal generating sub-circuit and a data signal generating sub-circuit. When the scan signal (Gate voltage) supplied by a first output terminal M of the time sequence control sub-circuit to the gate signal terminal Gate line shown in FIG. 3 is a low-level signal, the second output terminal N of the time sequence control sub-circuit supplies a data signal (Data voltage) to the data signal terminal Data line shown in FIG. 3; meanwhile, the time sequence control sub-circuit determines the driving time sequence of the switch control signal pre-stored in the look-up table corresponding to the data signal, and outputs the driving time sequence to the switch signal control terminal S1 shown in FIG. 3 through the third output terminal O of the time sequence control sub-circuit, so that the switch control sub-circuit 302 controls, according to the driving time sequence, the time period during which the first terminal Q or the second terminal P of the latch sub-circuit 303 is conductive with the first node N1.

Hereinafter, the working procedure of the pixel circuit provided by the embodiment of the present disclosure as shown in FIG. 3 within the display time of one frame will be described, in conjunction with the pixel circuit shown in FIG. 3 and the working timing diagram shown in FIG. 5 with respect to the pixel circuit shown in FIG. 3 within the display time of one frame.

Figure 5A:
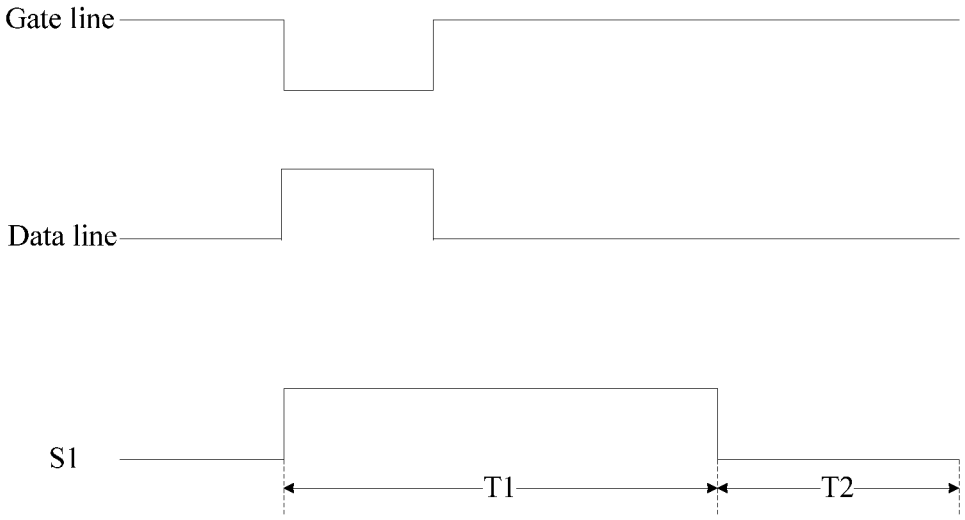
FIG. 5*a* is a first working timing diagram of the pixel circuit shown in FIG. 3 within the display time of one frame provided by the embodiment of the present disclosure.

Specifically, in the pixel circuit shown in FIG. 3 provided by the embodiment of the present disclosure, it is assumed that the high-level signal supplied by the high-level signal terminal VDD is 5V, and the low-level signal supplied by the low-level signal terminal VSS is −5V, and the data signal output by the data signal terminal Data line is a 4V high-level signal. As shown in FIG. 5*a*, when the scan signal supplied by the gate signal terminal Gate line is the low-level signal, the first switch transistor M1 is turned on, and at this time, the data signal terminal Data line supplies the 4V high-level signal and writes into the first node N1; meanwhile, the time sequence control sub-circuit shown in FIG. 4 determines the driving time sequence, pre-stored in the look-up table corresponding to the 4V data signal, of the switch control signal, and outputs the driving time sequence to the switch signal control terminal S1. Specifically, as shown in FIG. 5*a*, the driving time sequence may be that the high-level signal input by the switch signal control terminal S1 is maintained for a time period of T1 within the display time of one frame, and the low-level signal input by the switch signal control terminal S1 is maintained for a time period of T2 within the display time of one frame. In addition, when the high-level signal input by the switch signal control terminal S1 is maintained for the time period of T1 within the display time of one frame, the first node N1 is conductive with the first terminal Q of the latch sub-circuit 303, and the light-emitting sub-circuit 304 is lit; and afterwards, the low-level signal input by the switch signal control terminal S1 is maintained for the time period of T2 within the display time of one frame, at which time, the first node N1 is conductive with the second terminal P of the latch sub-circuit 303, and the light-emitting sub-circuit 304 does not emit light. Finally, weighting and averaging is obtained on the brightness of the light-emitting sub-circuit 304 within the time of one frame, so that the gray scale corresponding to the light-emitting sub-circuit 304 under the 4V data signal within the display time of one frame can be obtained.

Figure 5B:
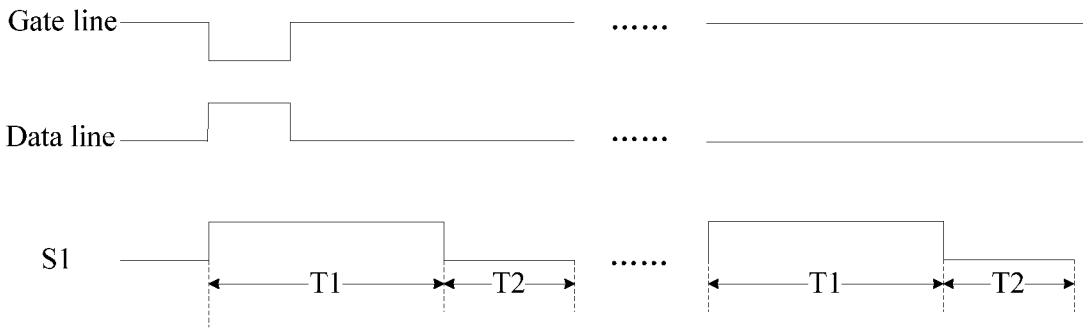
FIG. 5*b* is a working timing diagram of the pixel circuit shown in FIG. 3 within the display time of multiple frames provided by the embodiment of the present disclosure.

Further, as shown in FIG. 5*b*, it is the working timing diagram of the pixel circuit shown in FIG. 3 within the display time of multiple frames provided by the embodiments of the present disclosure. From FIG. 5*b*, it can be seen that, only within the display time of the first frame, the 4V high-level signal is loaded by the data signal terminal Data line, and no data signal is loaded within the display time of each subsequent frame; in addition, within the display time of each frame, the switch signal control terminal S1 loads switch control signals of the same duty cycle (i.e., within the display time of respective frames, high-level signals in the switch control signal are all maintained for the time period of T1, and low-level signals are all maintained for the time period of T2). Therefore, as triggered by the data signal loaded within the display time of the first frame, the switch control sub-circuit 302 controls, within the display time of each frame, the time period during which the first terminal Q or the second terminal P of the latch sub-circuit 303 is conductive with the first node N1, and further, when a static picture of a gray scale corresponding to the 4V data signal is displayed within the time of multiple frames, it is not necessary to repeatedly refresh the data signal required within the display time of each frame, which reduces the power consumption of the pixel circuit.

In addition, based on the similar principle of implementing the static picture of the gray scale corresponding to the 4V data signal as described above, after the driving time sequence of a switch control signal corresponding to each data signal set in the look-up table of the time sequence control sub-circuit shown in FIG. 4 is determined, conducting the first node N1 with the first terminal Q or the second terminal P of the latch sub-circuit 303 can be controlled according to these driving time sequences, to further control the potential of the first node N1, so that the light-emitting sub-circuit 304 implements different gray scales under different data signals, so as to implement the display of pictures of different gray scales.

Figure 5C:
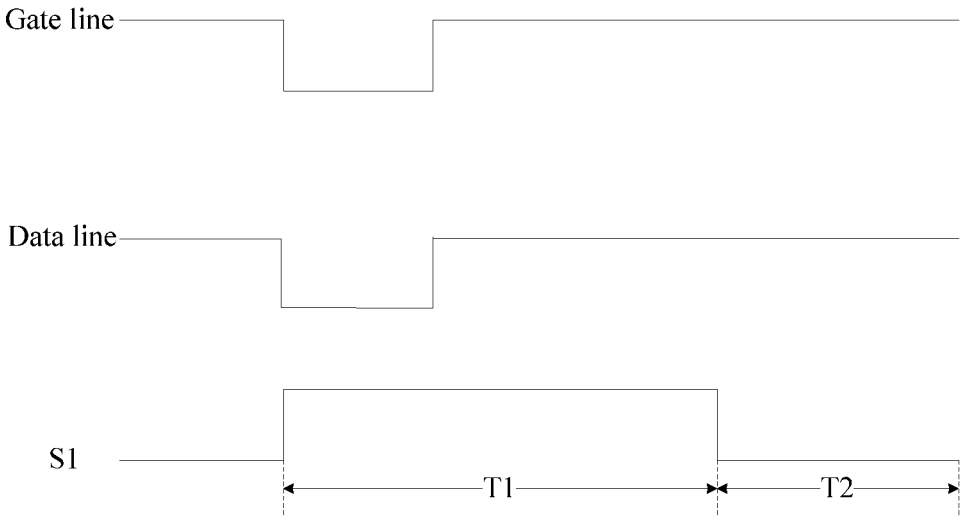
FIG. 5*c* is a second working timing diagram of the pixel circuit shown in FIG. 3 within the display time of one frame provided by the embodiment of the present disclosure.

It should be noted that, in the working timing diagram of the pixel circuit shown in FIG. 3 within the display time of one frame provided by the embodiments of the present disclosure, when the data signal terminal Data line inputs the high-level signal, it is possible to implement the operations that the light-emitting sub-circuit 304 emits light within the time period T1 during which the first terminal Q of the latch sub-circuit 303 is conductive with the first node N1, and the light-emitting sub-circuit 304 does not emit light within the time period T2 during which the second terminal P of the latch sub-circuit 303 is conductive with the first node N1. During implementation, with respect to the pixel circuit shown in FIG. 3 provided in the embodiments of the present disclosure, within the display time of one frame, it is also possible to set that, when the data signal terminal Data line inputs the low-level signal, the light-emitting sub-circuit 304 does not emit light within the time period T1 during which the first terminal Q of the latch sub-circuit 303 is conductive with the first node N1, and the light-emitting sub-circuit 304 emits light within the time period T2 during which the second terminal P of the latch sub-circuit 303 is conductive with the first node N1, as shown in FIG. 5*c*, which will not be limited here.

It should be noted that, all the switch transistors mentioned in the above-described pixel circuits provided by the present disclosure may be thin film transistors (TFTs), and may also be metal oxide semiconductor (MOS) field effect transistors, which are not limited here. In addition, during implementation, the source electrode and the drain electrode of these switch transistors are fabricated in a same process; they are nominally interchangeable, and may be changed in name according to a voltage direction, which will not be specifically distinguished here.

An embodiment of the present disclosure further provides a display panel, comprising any one of the above-described pixel circuits and a time sequence control sub-circuit.

An embodiment of the present disclosure further provides a display device, comprising the above-described display panel. The display device may further comprise a touch panel.

In addition, the display device provided by the embodiment of the present disclosure comprises, but is not limited to, a mobile phone, a tablet personal computer, a television, a display sub-circuit, a laptop, a digital photo frame, a navigator, a smart watch, a fitness wristband, a personal digital assistant, and any other product or component having a display function.

Based on the same inventive concept, an embodiment of the present disclosure provides a driving method of the above-described pixel circuit. Because the principle in which the driving method solves the problem is similar to the principle in which the pixel circuit solves the problem, implementation of the above-described pixel circuit provided by the embodiment of the present disclosure may be referred to for implementation of the driving method provided by the embodiment of the present disclosure, which will not be repeated here.

Figure 6:
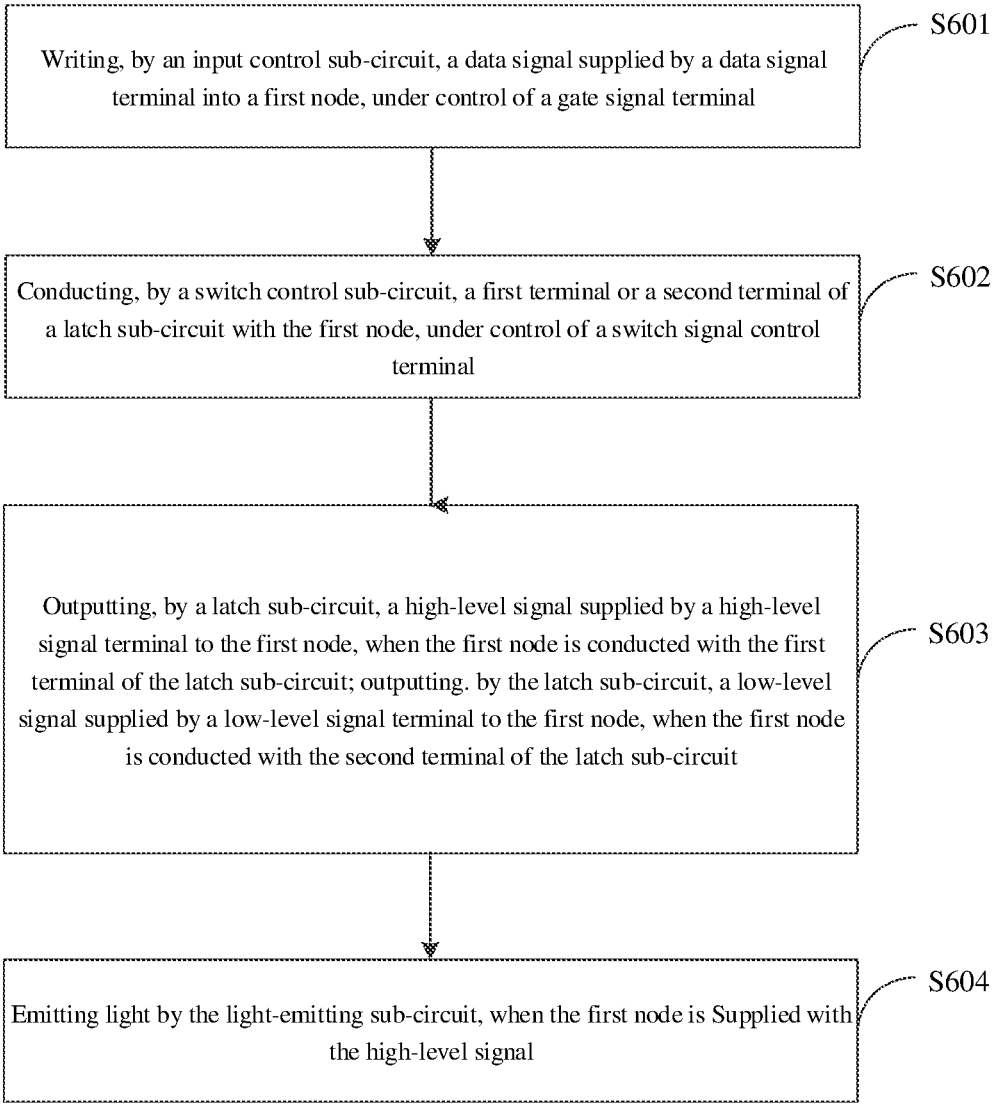
FIG. 6 is a flow chart of a driving method of a pixel circuit provided by an embodiment of the present disclosure.

Specifically, the driving method of the above-described pixel circuit provided by the embodiments of the present disclosure, as shown in FIG. 6, specifically comprises following steps:

S601: writing, by an input control sub-circuit, a data signal supplied by a data signal terminal into a first node under control of a gate signal terminal;

S602: conducting, by a switch control sub-circuit, a first terminal or a second terminal of a latch sub-circuit with the first node under control of a switch signal control terminal;

S603: outputting, by a latch sub-circuit, a high-level signal supplied by a high-level signal terminal to the first node, when the first node is conductive with the first terminal of the latch sub-circuit; outputting, by the latch sub-circuit, a low-level signal supplied by a low-level signal terminal to the first node, when the first node is conductive with the second terminal of the latch sub-circuit; wherein the smaller the voltage difference between the data signal and the high-level signal, the longer the time period during which the first terminal of the latch sub-circuit is conductive with the first node within the display time of one frame;

S604: emitting light by the light-emitting sub-circuit, when the first node is supplied with the high-level signal.

Specifically, in the above-described driving method provided by the embodiment of the present disclosure, when a static picture is displayed, only within the display time of a first frame, the data signal terminal loads the data signal; and within the display time of each frame, the switch signal control terminal loads switch control signals of a same duty cycle. In this way, it is not necessary to repeatedly refresh the data signal within the display time of each frame, so that power consumption of the pixel circuit may be reduced.

In the above-described pixel circuit and the driving method thereof, the display panel and the display device provided by the embodiments of the present disclosure, within the display time of one frame, as triggered by the data signal, the switch control sub-circuit can control the time period during which the first terminal or the second terminal of the latch sub-circuit is conductive with the first node, according to the switch control signal loaded by the switch signal control terminal, so as to further implement the gray scale corresponding to the light-emitting sub-circuit within the display time of one frame. Therefore, when the fixed-grayscale static picture is displayed within the display time of multiple frames, the data signal may be loaded by the data signal terminal, only within the display time of the first frame; and within the display time of each frame, the switch control signals of the same duty cycle are loaded by the switch signal control terminal, so that as triggered by the data signal loaded within the display time of the first frame, the switch control sub-circuit controls, within the display time of each frame, the time period during which the first terminal or the second terminal of the latch sub-circuit is conductive with the first node, and further it is not necessary to repeatedly refresh the data signal required within the display time of each frame, which reduces the power consumption of the pixel circuit.

It should be noted that, in this specification, terms like "first" and "second" are only used for differentiating one entity or operation from another, but are not necessarily used for indicating any practical relationship or order between these entities or operations.

It is evident that one person skilled in the art can make various changes or modifications to the present disclosure without departure from the spirit and scope of the present disclosure. Thus, if these changes and modifications to the present disclosure are within the scope of the claims of the present disclosure and equivalent technologies, the present disclosure also intends to include all such changes and modifications within its scope.

The above are only specific embodiments of the present application, but the scope of the embodiment of the present disclosure is not limited thereto, and any skilled in the art, within the technical scope disclosed by the embodiment of the present disclosure, can easily think of variations or replacements, which should be covered within the protection scope of the embodiment of the present disclosure. Therefore, the scope of the present disclosure should be the scope of the following claims.

What is claimed is:

1. A pixel circuit, comprising: an input control sub-circuit, a switch control sub-circuit, a latch sub-circuit and a light-emitting sub-circuit;

wherein the input control sub-circuit is configured to write a data signal supplied by a data signal terminal into a first node under control of a gate signal terminal;

the switch control sub-circuit is configured to conduct a first terminal or a second terminal of the latch sub-circuit with the first node under control of a switch signal control terminal;

the latch sub-circuit is configured to: output a high-level signal supplied by a high-level signal terminal to the first node, when the first node is conductive with the first terminal of the latch sub-circuit, and output a low-level signal supplied by a low-level signal terminal to the first node, when the first node is conductive with the second terminal of the latch sub-circuit; and the light-emitting sub-circuit is configured to emit light when the first node is supplied with the high-level signal.

2. The pixel circuit according to claim 1, wherein a control terminal of the input control sub-circuit is connected with the gate signal terminal, an input terminal of the input control sub-circuit is connected with the data signal terminal, and an output terminal of the input control sub-circuit is connected with the first node;

a control terminal of the switch control sub-circuit is connected with the switch signal control terminal, a first terminal of the switch control sub-circuit is connected with the first node, a second terminal of the switch control sub-circuit is connected with the first terminal of the latch sub-circuit, and a third terminal of the switch control sub-circuit is connected with the second terminal of the latch sub-circuit;

a third terminal of the latch sub-circuit is connected with the high-level signal terminal, and a fourth terminal of the latch sub-circuit is connected with the low-level signal terminal; and the light-emitting sub-circuit is connected between the first node and the low-level signal terminal.

3. The pixel circuit according to claim 2, wherein the input control sub-circuit includes: a first switch transistor and a capacitor;

a gate electrode of the first switch transistor is connected with the gate signal terminal, a source electrode of the first switch transistor is connected with the data signal terminal, and a drain electrode of the first switch transistor is connected with the first node; and a first terminal of the capacitor is connected with the first node, and a second terminal of the capacitor is grounded.

4. The pixel circuit according to claim 2, wherein the switch control sub-circuit includes: a second switch transistor and a third switch transistor that are oppositely doped;

a gate electrode of the second switch transistor and a gate electrode of the third switch transistor are respectively connected with the switch signal control terminal;

a source electrode of the second switch transistor and a drain electrode of the third switch transistor are respectively connected with the first node;

a drain electrode of the second switch transistor is connected with the first terminal of the latch sub-circuit; and a source electrode of the third switch transistor is connected with the second terminal of the latch sub-circuit.

5. The pixel circuit according to claim 2, wherein the latch sub-circuit includes: a fourth switch transistor and a fifth switch transistor that are oppositely doped, and a sixth switch transistor and a seventh switch transistor that are oppositely doped, wherein a gate electrode of the fourth switch transistor and a gate electrode of the fifth switch transistor are respectively connected with the second terminal of the latch sub-circuit;

a drain electrode of the fourth switch transistor and a drain electrode of the fifth switch transistor are respectively connected with the first terminal of the latch sub-circuit;

a gate electrode of the sixth switch transistor and a gate electrode of the seventh switch transistor are respectively connected with the first terminal of the latch sub-circuit;

a drain electrode of the sixth switch transistor and a drain electrode of the seventh switch transistor are respectively connected with the second terminal of the latch sub-circuit;

a source electrode of the fourth switch transistor and a source electrode of the sixth switch transistor are respectively connected with the low-level signal terminal; and a source electrode of the fifth switch transistor and a source electrode of the seventh switch transistor are respectively connected with the high-level signal terminal.

6. The pixel circuit according to claim 1, wherein a time period during which the first terminal of the latch sub-circuit is conductive with the first node and a time period during which the second terminal of the latch sub-circuit is conductive with the first node are both related to a voltage of the data signal.

7. The pixel circuit according to claim 6, wherein the smaller a voltage difference between the data signal and the high-level signal, the longer the time period during which the first terminal of the latch sub-circuit is conductive with the first node within display time of one frame.

8. The pixel circuit according to claim 1, wherein the input control sub-circuit includes: a first switch transistor and a capacitor;

a gate electrode of the first switch transistor is connected with the gate signal terminal, a source electrode of the first switch transistor is connected with the data signal terminal, and a drain electrode of the first switch transistor is connected with the first node; and a first terminal of the capacitor is connected with the first node, and a second terminal of the capacitor is grounded.

9. The pixel circuit according to claim 1, wherein the switch control sub-circuit includes: a second switch transistor and a third switch transistor that are oppositely doped;

a gate electrode of the second switch transistor and a gate electrode of the third switch transistor are respectively connected with the switch signal control terminal;

a source electrode of the second switch transistor and a drain electrode of the third switch transistor are respectively connected with the first node;

a drain electrode of the second switch transistor is connected with the first terminal of the latch sub-circuit; and a source electrode of the third switch transistor is connected with the second terminal of the latch sub-circuit.

10. The pixel circuit according to claim 9, wherein the second switch transistor is an N-type transistor, and the third switch transistor is a P-type transistor; the longer a time period of the high-level signal input by the switch signal control terminal, the longer the time period during which the first terminal of the latch sub-circuit is conductive with the first node; or, the second switch transistor is a P-type transistor, and the third switch transistor is an N-type transistor; the longer a time period of the low-level signal input by the switch signal control terminal, the longer the time period during which the first terminal of the latch sub-circuit is conductive with the first node.

11. The pixel circuit according to claim 1, wherein the latch sub-circuit includes: a fourth switch transistor and a fifth switch transistor that are oppositely doped, and a sixth switch transistor and a seventh switch transistor that are oppositely doped, wherein a gate electrode of the fourth switch transistor and a gate electrode of the fifth switch transistor are respectively connected with the second terminal of the latch sub-circuit;

a drain electrode of the fourth switch transistor and a drain electrode of the fifth switch transistor are respectively connected with the first terminal of the latch sub-circuit;

a gate electrode of the sixth switch transistor and a gate electrode of the seventh switch transistor are respectively connected with the first terminal of the latch sub-circuit;

a drain electrode of the sixth switch transistor and a drain electrode of the seventh switch transistor are respectively connected with the second terminal of the latch sub-circuit;

a source electrode of the fourth switch transistor and a source electrode of the sixth switch transistor are respectively connected with the low-level signal terminal; and a source electrode of the fifth switch transistor and a source electrode of the seventh switch transistor are respectively connected with the high-level signal terminal.

12. The pixel circuit according to claim 11, wherein the fourth switch transistor and the sixth switch transistor are N-type transistors, and the fifth switch transistor and the seventh switch transistor are P-type transistors; or, the fourth switch transistor and the sixth switch transistor are P-type transistors, and the fifth switch transistor and the seventh switch transistor are N-type transistors.

13. The pixel circuit according to claim 1, wherein the light-emitting sub-circuit includes: a light-emitting diode;

an anode of the light-emitting diode is connected with the first node, and a cathode of the light-emitting diode is connected with the low-level signal terminal.

14. The pixel circuit according to claim 13, wherein the light-emitting diode includes: an organic light-emitting diode or a quantum dot light-emitting diode.

15. A driving method of the pixel circuit according to claim 1, comprising:

writing, by an input control sub-circuit, a data signal supplied by a data signal terminal into a first node under control of a gate signal terminal;

conducting, by a switch control sub-circuit, a first terminal or a second terminal of a latch sub-circuit with the first node under control of a switch signal control terminal;

outputting, by the latch sub-circuit, a high-level signal supplied by a high-level signal terminal to the first node, when the first node is conductive with the first terminal of the latch sub-circuit; outputting, by the latch sub-circuit, a low-level signal supplied by a low-level signal terminal to the first node, when the first node is conductive with the second terminal of the latch sub-circuit; and emitting light by the light-emitting sub-circuit, when the first node is supplied with the high-level signal.

16. The driving method according to claim 15, wherein the smaller a voltage difference between the data signal and the high-level signal, the longer a time period during which the first terminal of the latch sub-circuit is conductive with the first node within display time of one frame.

17. The driving method according to claim 16, wherein only within display time of a first frame, the data signal terminal loads the data signal; and within display time of each frame, the switch signal control terminal loads switch control signals of a same duty cycle.

18. The driving method according to claim 15, wherein only within display time of a first frame, the data signal terminal loads the data signal; and within display time of each frame, the switch signal control terminal loads switch control signals of a same duty cycle.

19. A display panel, comprising the pixel circuit according to claim 1.

20. A display device, comprising the display panel according to claim 19.

* * * * *